US006839950B2

(12) United States Patent
Guillot

(10) Patent No.: US 6,839,950 B2
(45) Date of Patent: Jan. 11, 2005

(54) FRAME ASSEMBLY FOR MODULAR FURNITURE AND METHOD OF ASSEMBLING THE SAME

(75) Inventor: Edmond P. Guillot, Conover, NC (US)

(73) Assignee: Hickory Springs Manufacturing Company, Hickory, NC (US)

( * ) Notice: Subject to any disclaimer, the term of this patent is extended or adjusted under 35 U.S.C. 154(b) by 0 days.

(21) Appl. No.: 10/436,598

(22) Filed: May 13, 2003

(65) Prior Publication Data

US 2003/0193230 A1 Oct. 16, 2003

Related U.S. Application Data

(62) Division of application No. 09/861,343, filed on May 18, 2001, now Pat. No. 6,692,079.

(51) Int. Cl.[7] ..... B21D 39/03
(52) U.S. Cl. ..... 29/428; 297/440.16; 297/440.14
(58) Field of Search ..... 29/428, 91.1, 469, 29/91; 297/440.1, 440.14, 440.15, 440.21, 440.2, 440.22, 440.16

(56) References Cited

U.S. PATENT DOCUMENTS

| | | | | |
|---|---|---|---|---|
| 1,278,491 A | | 9/1918 | Metzger | |
| 1,478,640 A | | 12/1923 | Coverly | |
| 2,597,860 A | | 5/1952 | Gerber et al. | |
| 2,605,820 A | | 8/1952 | Powellek | |
| 2,620,024 A | | 12/1952 | Rietman | |
| 2,650,656 A | | 9/1953 | Ohlsson | |
| 2,650,657 A | | 9/1953 | Ohlsson | |
| 2,678,088 A | | 5/1954 | Jamison | |
| 2,705,995 A | * | 4/1955 | McMurtry | 29/469 |
| 2,793,685 A | | 5/1957 | Spitz | |
| 2,913,041 A | * | 11/1959 | Mathison | 29/91.1 |
| 2,914,118 A | | 11/1959 | Sawyers | |
| 3,129,472 A | | 4/1964 | Hensel | |
| 3,564,700 A | * | 2/1971 | Binek | 29/415 |
| 3,658,382 A | | 4/1972 | Anderson | |
| 3,674,311 A | | 7/1972 | Miller | |
| 3,695,690 A | | 10/1972 | Carson | |
| 3,700,282 A | | 10/1972 | Rowland | |
| 3,774,966 A | | 11/1973 | Faulkner et al. | |
| 3,799,611 A | | 3/1974 | Steinfeld | |
| 3,842,456 A | | 10/1974 | Bronstien, Jr. | |
| 3,929,375 A | | 12/1975 | Gams | |
| 3,951,558 A | | 4/1976 | Komarov | |
| 3,966,340 A | | 6/1976 | Morris | |
| 3,973,800 A | | 8/1976 | Kogan | |
| 4,012,155 A | | 3/1977 | Morris | |
| 4,025,216 A | | 5/1977 | Hives | |
| 4,165,902 A | | 8/1979 | Ehrlich | |
| 4,204,287 A | | 5/1980 | Lane et al. | |
| 4,261,667 A | | 4/1981 | Ervin et al. | |

(List continued on next page.)

OTHER PUBLICATIONS

Simply Together ® "Furniture for Life"—Advertisement from ww.simplytogether.com (2 pages).

*Primary Examiner*—Milton Nelson, Jr.
(74) *Attorney, Agent, or Firm*—Alston & Bird LLP

(57) ABSTRACT

A frame assembly for securing a plurality of modular sofa parts together into a sofa frame. The frame assembly includes a pair of tapered members attached to opposing sides of a backrest sofa part and a pair of receptacles attached to a respective one of a pair of rails, which are in turn attached to a pair of armrests. The backrest is connected to the armrests by inserting each of the tapered members into a tapered slot defined by each respective receptacle and is further strengthened using a pair of overlapping securing members. The tapered shape of the tapered members and slots produces a positive fit that has two directional components to prevent rocking of the backrest in two directions. The rails are configured to also accept a sleeper unit, and a futon unit allowing the sofa frame to be easily upgraded or adapted as desired by the user.

5 Claims, 6 Drawing Sheets

U.S. PATENT DOCUMENTS

| | | | | |
|---|---|---|---|---|
| 4,292,003 | A | | 9/1981 | Pond |
| 4,305,616 | A | | 12/1981 | Martinez |
| 4,365,840 | A | | 12/1982 | Kehl et al. |
| 4,395,071 | A | | 7/1983 | Laird |
| 4,668,011 | A | | 5/1987 | Fister, Jr. |
| 4,691,965 | A | | 9/1987 | Hsiung |
| 4,711,495 | A | | 12/1987 | Magder |
| 4,875,736 | A | * | 10/1989 | Brambilla ..... 297/440.1 |
| 4,883,331 | A | | 11/1989 | Mengel |
| 4,886,326 | A | | 12/1989 | Kuzyk |
| 4,890,888 | A | | 1/1990 | Kostin |
| 4,893,958 | A | | 1/1990 | Wieland |
| 4,932,720 | A | | 6/1990 | Sherman |
| 4,944,627 | A | | 7/1990 | Durney |
| 5,005,908 | A | | 4/1991 | Young |
| 5,007,681 | A | | 4/1991 | Meier et al. |
| 5,069,506 | A | | 12/1991 | Wieland |
| 5,080,438 | A | | 1/1992 | Moyer |
| 5,135,284 | A | | 8/1992 | Crum |
| 5,184,871 | A | | 2/1993 | LaPointe et al. |
| 5,232,266 | A | | 8/1993 | Mork |
| 5,263,764 | A | | 11/1993 | Laughlin et al. |
| 5,338,095 | A | | 8/1994 | Laughlin et al. |
| 5,394,573 | A | | 3/1995 | Laughlin et al. |
| 5,423,596 | A | | 6/1995 | Laughlin et al. |
| 5,518,298 | A | | 5/1996 | LaPointe et al. |
| 5,529,380 | A | | 6/1996 | Blansett |
| 5,551,757 | A | | 9/1996 | Glover |
| 5,658,049 | A | | 8/1997 | Adams et al. |
| 5,678,897 | A | | 10/1997 | Prestia |
| 5,738,414 | A | | 4/1998 | Wieland et al. |
| 5,890,767 | A | | 4/1999 | Chang |
| 6,241,317 | B1 | | 6/2001 | Wu |

* cited by examiner 17
15
30
28
35
31
26
22
32
25
24
33
34
23
20
21
16
27
56
55
57

FRAME ASSEMBLY FOR MODULAR FURNITURE AND METHOD OF ASSEMBLING THE SAME

CROSS-REFERENCE TO RELATED APPLICATIONS

This application is a divisional of U.S. application Ser. No. 09/861,343, filed May 18, 2001 now U.S. Pat. No. 6,692,079, which is hereby incorporated herein in its entirety by reference.

FIELD OF THE INVENTION

The present invention relates to the field of modular, ready-to-assemble furniture, and more specifically, a frame assembly for securing together a group of modular furniture parts to form a completed furniture piece.

BACKGROUND OF THE INVENTION

Furniture pieces are typically manufactured and assembled at a factory and then shipped as a complete unit to a distributor or customer. The sections of the furniture piece are typically joined together using bolts that extend through predrilled holes in wooden or metal parts of the sections. Upholstery is used to cover the furniture sections, including the bolts and wooden or metal parts of the sections. The completed furniture piece is typically too heavy to be handled by a single individual and too large to be maneuvered through some doorways and stairwells. As a result, customers may limit the furniture that they choose to purchase or may object to additional charges required for third-party delivery of the furniture. In addition, it is difficult to efficiently pack assembled furniture pieces due to their size, shape and the fragility of the upholstered surfaces. Damage to any portion of the furniture piece typically requires the entire furniture piece to be shipped to a factory for repair.

One approach to this problem has been through the use of ready-to-assemble (RTA) furniture that provides increased options for storage, delivery and assembly of the furniture. For instance, U.S. Pat. No. 5,338,095 to Laughlin et al. discloses a furniture piece that relies on interlocking frame members to secure the modular sections together. The interlocking joints are designed to be easy to assemble. In one instance, a pair of combined wedge and parallelepiped shaped sockets 64 defined at the lower ends of a pair of vertical side members 72 of a backrest member 26 allow the backrest member to be secured to a pair of rail members 50, as shown in FIG. 3. Despite the ease of assembly, the furniture disclosed by Laughlin, and other conventional RTA furniture, can suffer from looseness in the fit between the modular sections that results in instability. For example, a looseness in fit due to repetitive loading can result in wobble or rocking of the backrest relative to the base of the furniture piece. Laughlin attempts to solve this problem with the addition of a pair of thumbscrews 96 that secure the backrest member to respective wing portions 100 of the seat. However, a pair of unsightly flaps in the upholstery are necessary to secure the thumbscrews and the thumbscrews require the presence of the wing portions for attachment, thereby limiting aesthetic design variations.

Attempts have been made to eliminate the problem of instability through other variations in the method of assembling, or fastening, the modular pieces together. For instance, U.S. Pat. No. 5,551,757 to Glover discloses a fastening system for RTA furniture. The fastening system employs side-support rails secured to the arm sections of the seat which allow either a seat platform or a foldout bed platform to be secured within the furniture piece. A pair of hooks are mounted to a back section and the back section is connected to the side-support rails and between a pair of armrests by mounting the hooks on a pair of engagement pins of the side-support rails. The back section is further secured using hard bolts 88 that are fed through the back section and into the armrests, as shown in FIG. 2. Although the fastening system of the Glover patent increases the rigidity of the assembled back section, the back section is divided into two portions that can be disengaged to allow access for insertion of the hard bolts into the armrests. This two-piece back section is more costly to produce than a conventional sofa back section.

It would be advantageous to have a frame assembly for RTA modular furniture that allows the furniture to be quickly assembled and yet has relatively rigid construction without sacrificing aesthetic appeal. It would be further advantageous if the backrest of the furniture could be rigidly secured to the base of the furniture piece using the frame assembly without undue visible alterations in the appearance of the backrest or base of the furniture piece. It would be further advantageous if the frame assembly were adaptable to different aesthetic variations of furniture and different types of furniture, such as sleeper sofas.

SUMMARY OF THE INVENTION

The present invention addresses the above needs and achieves other advantages by providing a frame assembly for securing a plurality of modular sofa parts together into the sofa frame by producing a positive fit between one, or more, of the modular sofa parts. More particularly, the frame assembly includes a pair of tapered members attached to opposing sides of a backrest sofa part and a pair of receptacles attached to respective ones of a pair of rails, which are in turn attached to a pair of armrests. The backrest is connected between, and to, the armrests and rails by inserting each of the tapered members into a tapered slot defined by each respective receptacle. The tapered shape of the tapered members and slots produces the positive fit that has two directional components to prevent front-to-back rocking, and side-to-side rocking, of the backrest. The positive fit between each tapered member and receptacle is further strengthened using a pair of overlapping securing members each connected to a respective one of the tapered member and receptacle. The securing members may be transfixed with a hand bolt which is tightened to draw the tapered member further into the tapered slot. Further, the rails each define a plurality of holes configured to accept one of a pair of spaced drop-in supports of a spring unit, a sleeper unit, and a futon unit allowing the sofa frame to be easily upgraded or adapted as desired by the user.

In one embodiment, the frame assembly secures a plurality of modular sofa parts together into a sofa frame. The modular sofa parts include a pair of base walls, a pair of armrests and a backrest. The frame assembly includes a pair of elongate rails, a pair of receptacles and a pair of tapered members. Each of the elongate rails includes a pair of spaced bracket portions configured for attachment to a common one of the armrests. Each spaced bracket portion is further configured for attachment to a respective one of the pair of base walls. Each receptacle has a wall structure defining a tapered slot and each receptacle is attached to a respective one of the pair of elongate rails. The pair of tapered members are configured for attachment to the backrest. Each tapered member has at least one tapered outer surface receivable by a corresponding one of the pair of receptacles in a positive fit.

The frame assembly can be assembled by spacing apart the pair of elongate rails and attaching the bracket portions of the elongate rails to their respective base walls so as to space apart the base walls and secure the base walls to the elongate members. The pair of tapered members are also spaced apart and attached to the backrest. Once attached to the backrest, the tapered members are inserted into the receptacles so that each of the tapered outer surfaces is engaged with a respective tapered slot in a positive fit which rigidifies the sofa frame.

In another aspect, the pair of tapered members each include a second tapered outer surface so that the positive fit is configured to extend in multiple directions. The tapered slot defined by each wall structure may have a flattened triangular shape and the tapered outer surface of each tapered member also has a flattened triangular shape which configures the positive fit to extend in the first direction. The flattened triangular shape may also have a trapezoidal cross-section that forms a second pair of tapered surfaces which configures the positive fit to extend in a second direction. The first and second directions correspond to front-to-back, and side-to-side, motions relative to the sofa frame.

In yet another aspect, the walls structure defining the tapered slot includes at least three inner surfaces. A first inner surface has a triangular shape with a pair of vertical edges. A pair of second inner surfaces are spaced apart across the first inner surface and extend inwards from the vertical edges of the triangular shape. Each tapered member may include three of the tapered surfaces wherein each tapered surface is congruently shaped to a respective one of the at least three inner surfaces so that the positive fit extends in at least two directions.

In another embodiment, the pair of elongate rails each include a first and second overlapping channels that slidingly interfit. The first bracket is attached to the first channel and the second bracket is attached to the second channel allowing spacing between the bracket portions to be adjusted for differently sized armrests.

In another aspect, each receptacle further includes a first securing member and each tapered member includes a second securing member. The first and second securing members are configured to overlap and receive a fastener so that each tapered member can be secured to the corresponding one of the receptacles. The first securing member may be positioned on a bottom portion of the tapered member. The second securing member may be positioned on a bottom portion of the receptacle so that tightening the fastener draws the tapered member further into the receptacle thereby increasing the positive fit.

In another embodiment, each of the pair of elongate rails are configured for attachment of a pair of drop-in unit supports. The elongate rails define a plurality of holes configured to receive fasteners for attaching a respective one of the drop-in unit supports. Preferably, the drop-in unit supports support any combination of a futon, a sleeper unit or a spring unit.

In yet another embodiment, the present invention includes a positive fit assembly for rigidly securing two modular furniture pieces together in a positive fit. The positive fit assembly includes a receptacle and a tapered member. The receptacle is configured for attachment to one of the modular furniture pieces and has a triangular first wall with a pair of vertical edges, a pair of second walls and a securing member. The pair of second walls are spaced apart across the triangular first wall and each extends inwards from a respective one of the pair of vertical edges of the triangular first wall. The triangular first wall and the second walls define a tapered slot and the securing member extends laterally from the triangular first wall.

The tapered member is configured for attachment to another one of the modular furniture pieces and has a triangular first surface with a pair of vertical edges, a pair of second surfaces and a second securing member. The pair of second surfaces each extend outwardly from a respective one of the pair of vertical edges and the securing member extends laterally from the triangular first surface.

The receptacle can be attached to its modular furniture piece. The tapered member can be attached to the other one of the furniture pieces. The two furniture pieces are connected by sliding the tapered member into the tapered slot defined by the walls of the receptacle until the pair of second surfaces are flush with the pair of second walls.

The present invention has several advantages. The modular sofa parts are firmly interconnected by the frame assembly into the sofa frame, while still being easy to assemble and disassemble without tools due to the use of several hand bolts and the positive fit of the tapered members and receptacles. The modular assembly further speeds up the assembly at the plant, showroom or home and can be performed by a single person. The modular sofa parts are more efficiently shipped due to more efficient packing of the parts. The positive fit of the tapered members into the receptacles, aided by the securing members, increases stability of the backrest in at least two directions. The securing members are positioned so that they can be tightened before drop-in of the drop-in unit and do not require an unsightly access panel or hole in the upholstery. The sofa frame, and frame assembly, are easily adapted for use with a plurality of drop-in units, including a spring unit, a sleeper unit and a futon unit.

BRIEF DESCRIPTION OF THE DRAWINGS

Figure 1:
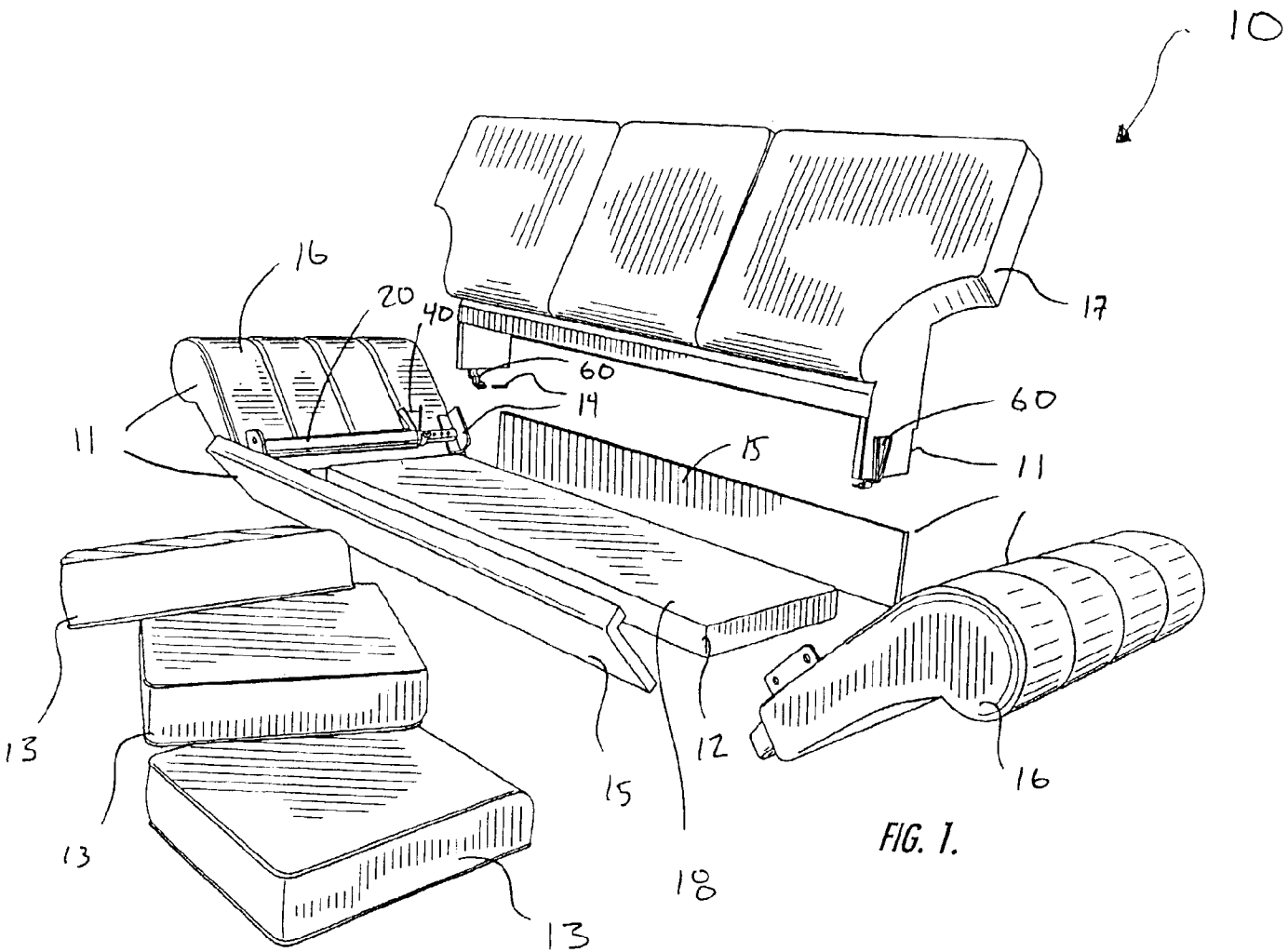
Figures 2, 3:
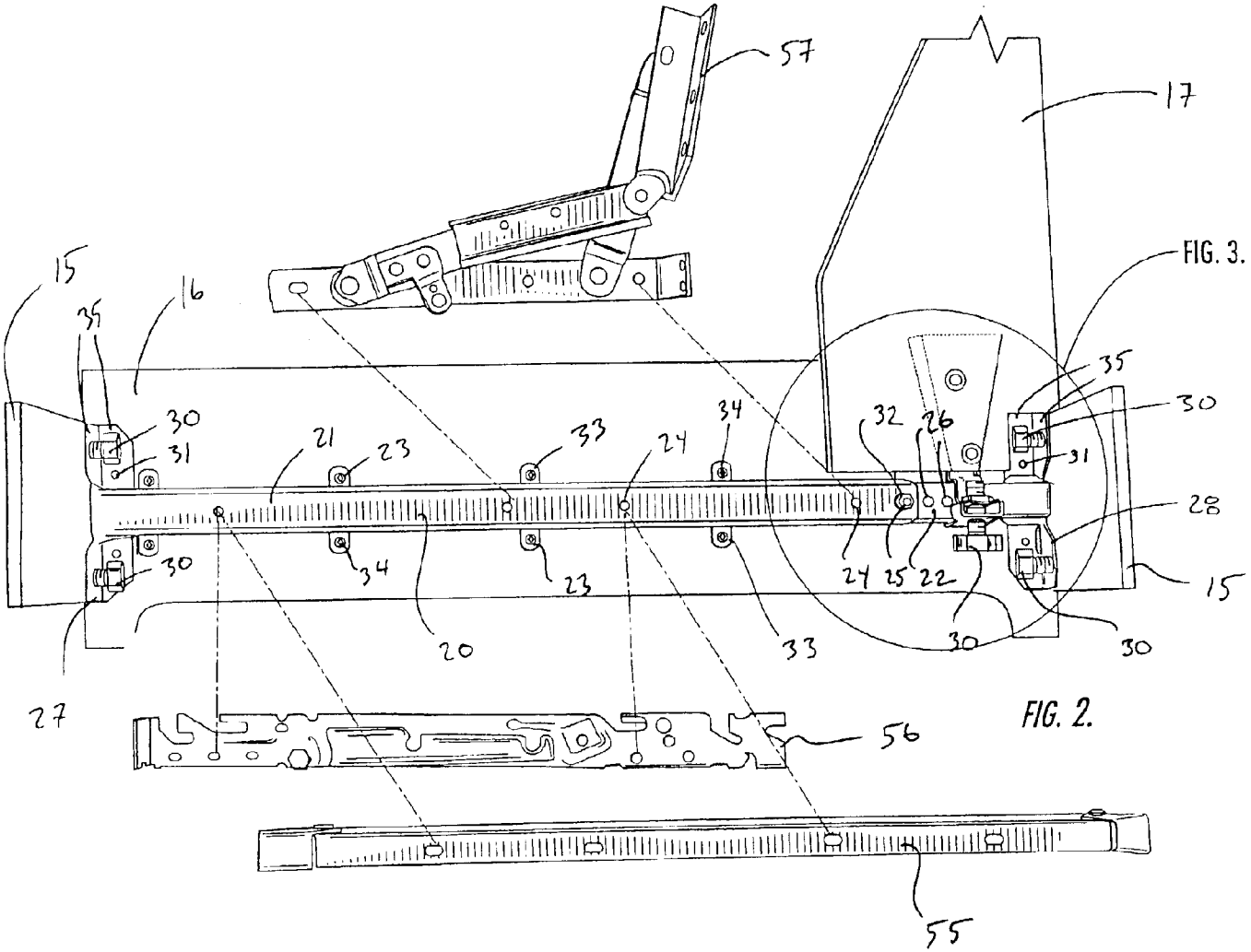
Figure 3:
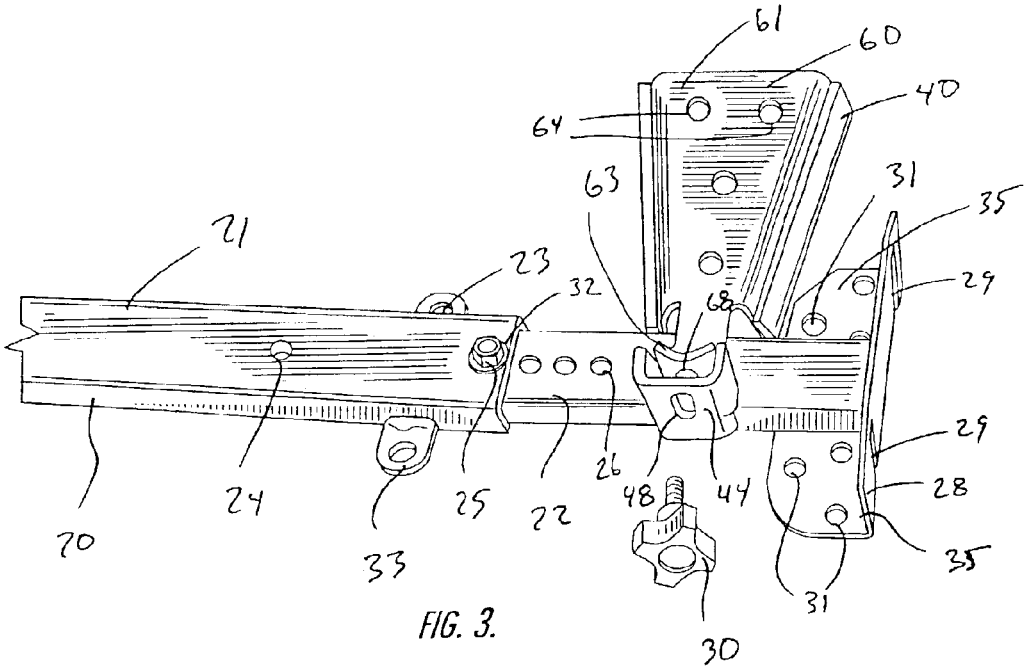
Figure 4:
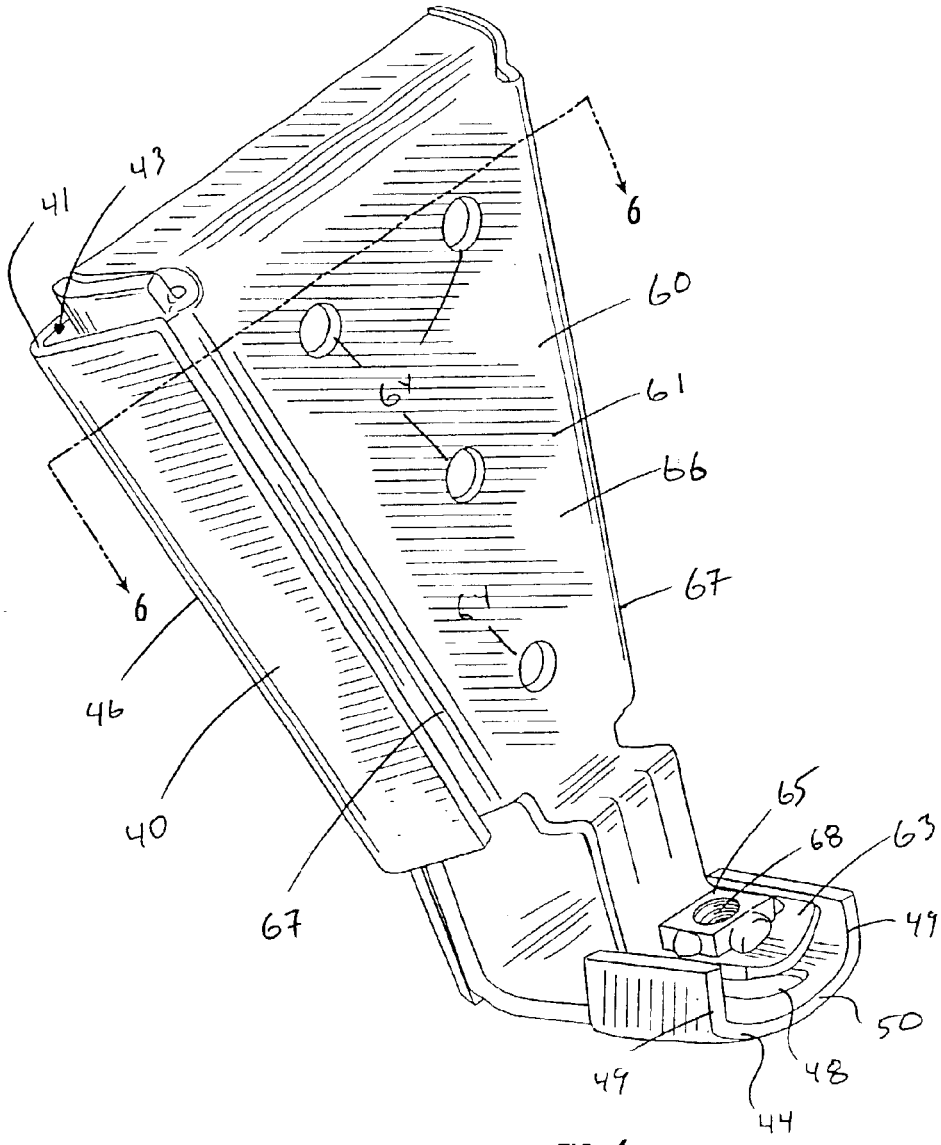
Figure 5:
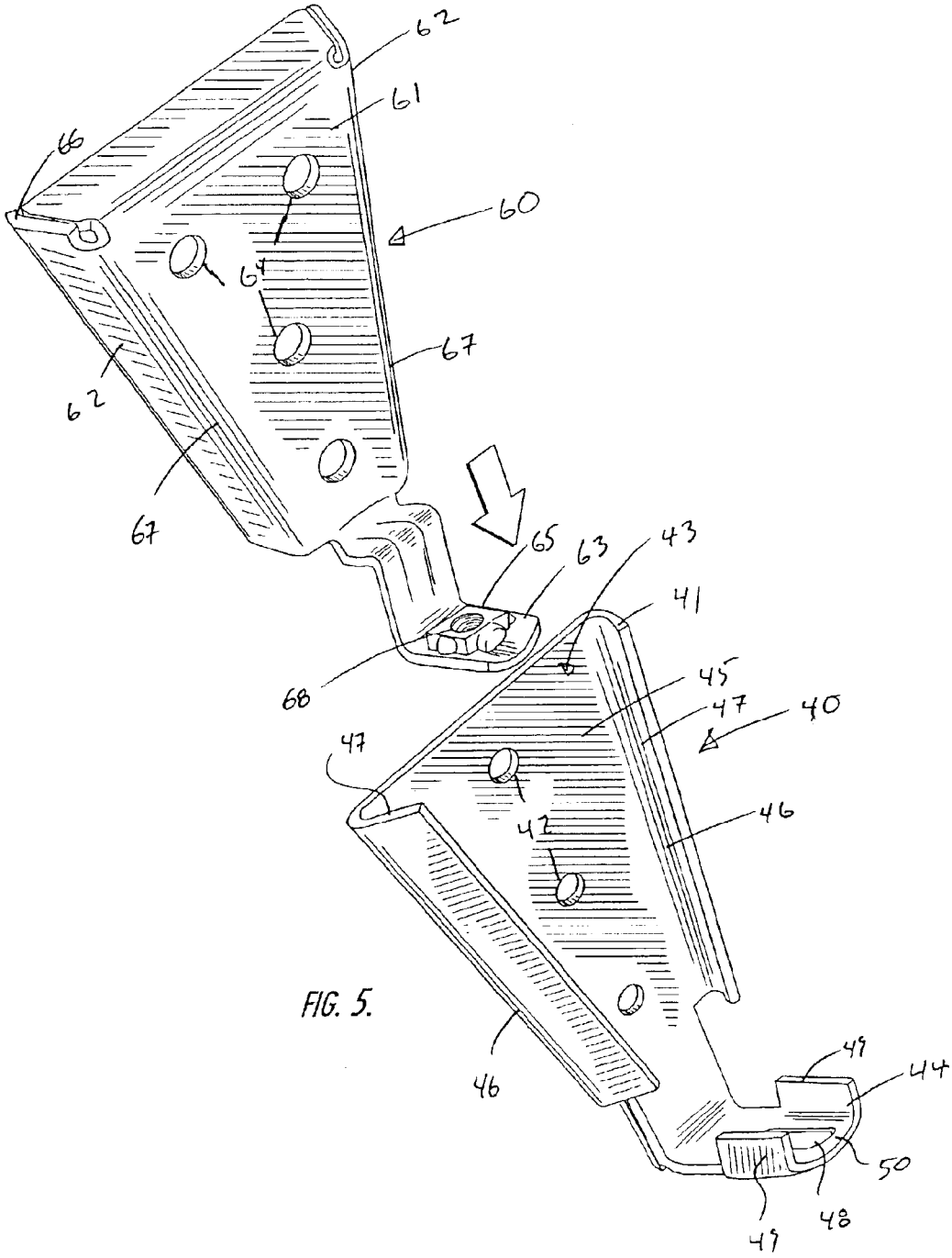
Figure 6:
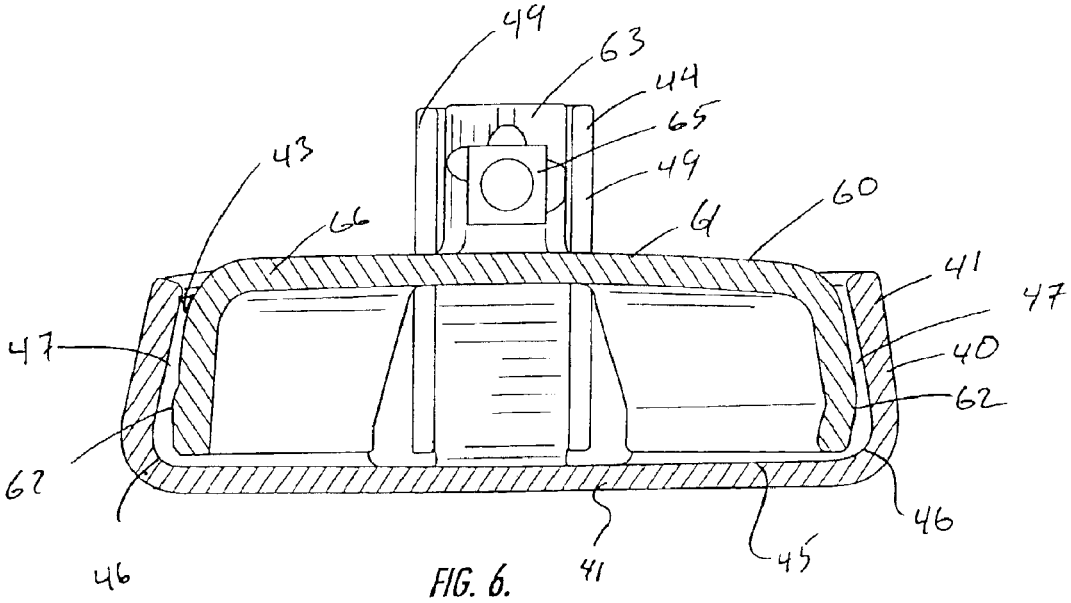

Having thus described the invention in general terms, reference will now be made to the accompanying drawings, which are not necessarily drawn to scale, and wherein:

FIG. 1 is an exploded view of one embodiment of a modular/RTA sofa including a frame support assembly of the present invention;

FIG. 2 is a sectional view of the assembled modular/RTA sofa of FIG. 1 showing an elongate rail, a receptacle and a tapered member of the frame support;

FIG. 3 is an enlarged view of the receptacle and tapered member attached to a portion of the elongate rail, as shown in FIG. 2;

FIG. 4 is a perspective view of a tapered member engaged in a receptacle of another embodiment of the present invention;

FIG. 5 is a perspective view of the tapered member and receptacle of FIG. 4, wherein the tapered member is disengaged from the receptacle; and FIG. 6 is a cross-sectional view of the tapered member and receptacle of FIG. 4.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

In one embodiment, the present invention includes a modular/RTA sofa assembly 10, as shown in FIG. 1. The sofa assembly 10 includes a sofa frame 11, a drop-in spring unit 12, and a plurality of cushions 13. The sofa frame 11 supports the drop-in spring unit 12, which in turn supports the cushions 13 that provide a comfortable seating surface for a user. The sofa frame 11 includes a frame support assembly 14 that reinforces and connects several modular sofa parts preferably comprising a pair of base walls 15, a pair of armrests 16 and a backrest 17. The support frame assembly 14 includes a pair of elongate rails 20, a pair of receptacles 40 and a pair of tapered members 60. The pair of elongate rails 20 are attached to the armrests 16 and the base walls 15 to provide a box-like seating and drop-in unit 12 support area. The pair of tapered members 60 are spaced apart and attached to opposing ends of the backrest 17. The pair of receptacles 40 are each attached near the back end of respective ones of the pair of elongate rails 20 and are configured to receive the pair of tapered members 60 therein so as to provide a relatively rigid completed sofa assembly 10.

The pair of elongate rails 20 each include an inner channel 22, an outer channel 21 and a pair of end brackets 27, 28, as shown in FIG. 2. The inner channel 22 has a continuous channel cross-section along its length, allowing the inner channel to be slidingly adjusted within the outer channel 21. Similarly, the outer channel 21 has a continuous channel cross-section, but the outer channel cross-section is slightly oversized in comparison to the cross-section of the inner channel 22. The slight oversize of the outer channel 21 allows the inner channel 22 to slide freely within the space defined between the outer channel 21 and the portion of the respective one of the armrests 16 to which the outer channel is attached.

The inner channel 21 defines a series of adjustment holes 26 preferably linearly spaced along the inner channel in increments of every ½ inch. The outer channel 22 defines an outer channel adjustment hole 32 which, when coincident with one of the adjustment holes 26 can be transfixed by an adjustment bolt 25. In this manner, the length of the elongate rails 20 can be adjusted to accommodate different furniture designs. For instance, the adjustment bolt 25 can be removed from the holes 25, 26 and the inner channel 22 slid within the outer channel 21 in half inch increments until the elongate rail 20 is long enough to span the distance between the pair of base walls 25, or is short enough to fit between the pair of base walls 15, if the elongate rail was originally too long. When the elongate rails 20 are each at an appropriate length, the pair of end-brackets 27, 28 are flush with the inner faces of the pair of base walls 15 allowing them to be affixed thereto. The size of the channels 21, 22 and the positioning of the holes can be varied, as desired. Several factors can determine the optimal size of the channels, such as the need for additional rigidity or the need to minimize weight of the furniture piece. Finer adjustments in length could be had, if desired, by spacing the adjustment holes 26 closer together, such as in ¼ inch increments.

The outer channel 21 preferably further includes a plurality of tabs 33 that extend from the edges of the outer channel at regular, spaced intervals. Each of the tabs defines an armrest connector hole 23 that can be transfixed by fasteners, such as the screws 34 shown in FIG. 2. The screws 34 firmly attach each of the outer channels 21 to their respective armrests 16. The size and spacing of the tabs 33, connector holes 23 and the type of fastener used can be varied depending upon such factors as the desired rigidity of the attachment, i.e., generally more and larger fasteners providing increased fixation, the desired weight and the desired ease of assembly, wherein less fasteners are generally preferred.

The outer channel 21 further defines a plurality of drop-in connector holes 24 that are positioned along the outer channel at strategic locations to allow the attachment of various drop-in unit supports. Preferably, the drop-in connector holes 24 allow the attachment of at least three drop-in unit supports, including a spring unit support 55, a sleeper unit support 56 and a futon unit support 57. As demonstrated by the broken lines in FIG. 2, one pair of the connector holes 24 toward the rear of the sofa frame 11 allows the attachment of the futon unit support 57. Another pair of the connector holes 24, allows the attachment of both the spring unit support 55 and the sleeper unit support 56. Attachment of a spring unit support 55 to both of the elongate rails 20 provides a ledge upon which the drop-in spring unit 12 may be rested to support the weight of user. The other supports 56, 57 also support their respective unit types, but are not described herein in further detail because their construction is known to those of skill in the art.

A first end-bracket 27 is positioned at, and attached to, the free end of the outer channel 21, while a second end-bracket 28 is attached to the free end of the inner channel 22. Each end bracket includes a pair of end-bracket walls 35 that share a common edge and are at right angles to each other, as shown in FIG. 3. One of the end-bracket walls 35 is configured to abut the adjacent one of the pair of armrests 16 and defines a plurality of armrest bracket holes 31. The armrest bracket holes may be transfixed by fasteners to attach the brackets 27, 28 to their respective adjacent armrests 16. The other one of the end-bracket walls 35 is configured to abut the adjacent one of the pair of base walls 15 and defines a plurality of base wall slots 29. The base wall slots are configured to be transfixed by a pair of large hand bolts 30 that connect the adjacent ones of the end-bracket walls 35 and base walls 15. The base walls 15 may define a plurality of predrilled holes to further facilitate attachment of the hand bolts 15. The elongated shape of the base wall slots 29 promote the easy attachment of the hand bolts 15 by allowing some initial play in the positioning of the slots coincident with the predrilled holes of the base walls 15. As mentioned above, the spacing between the brackets 27, 28 may be adjusted by adjusting the length of the elongate rails 20. Such adjustment allows the respective end-bracket walls 35 to be positioned adjacent the base walls 15.

Each of the hand bolts 30 preferably has a nob at one end for easy insertion into predrilled holes in the base walls 15 and subsequent tightening by hand. Hand bolts 30 are preferably used at the sites where attachment and detachment are likely to be performed by a consumer or during set-up in a showroom. The hand bolts could also be used in place of the other fasteners or bolts to promote adjustments by hand. Screws are preferably used in the present embodiment to secure the rails 20 to their respective armrests 16 in a more permanent manner than is available with the hand bolts 30 because detaching the rails from both the armrests and the base walls 15 is unnecessary for knockdown of the sofa assembly 10. In an alternative embodiment, fasteners could be used to secure the rails 20 length-wise to the base walls 15 and the hand bolts used to connect the rails to the armrests 16, which would still allow relatively easy knockdown. This may be preferable where the base walls 15 would benefit from the additional rigidity of the elongate rails 20.

Each of the receptacles 40 includes a wall structure 41 that defines a tapered slot 43, and a first securing member 44, as shown in FIGS. 4, 5 and 6. The walls structure 41 includes a first inner surface 45 and a pair of second inner surfaces 47. The first inner surface 45 preferably is triangular in shape and includes a pair of vertical edges 46 that define a downward taper of the slot 43. The downward taper of the slot promotes a positive fit of a respective one of the tapered members 60 into the slot in the downward direction, as will be described in more detail below. The pair of second inner surfaces 47 extend inwards from the vertical edges 46 of the first inner surface 45 and at an acute angle to the first inner surface so as to define a lateral taper of the slot 43. Restated in a different way, the pair of second inner surfaces 47 are spaced apart across the first inner surface 45 and extend inwards from the vertical edges 46 of the triangular shape of the first inner surface. The lateral taper of the slot defined by the second inner surfaces 47 promotes a positive fit of a respective one of the tapered members 60 into the slot in the lateral direction, as will be described in more detail below.

The first inner surface 45 preferably defines a plurality of armrest holes 42, as shown in FIG. 5, that may be transfixed by fasteners to attach the receptacles 40 to their respective armrests 16. In the illustrated embodiment, three serially spaced holes 42 are used for a secure attachment of the inner surface 45, and hence its one of the receptacles 40, in a flush arrangement with a vertically oriented frame member used to construct the armrests 16, as can be seen in FIG. 1. Attachment to the frame member reduces the likelihood of wobble, rocking or other relative displacement between the armrests 16 and their respective receptacles 40.

The first securing member 44 extends laterally from the first inner surface 45 and includes an overlap portion 50 and a pair of securing member walls 49, as shown in FIG. 5. The pair of walls 49 are spaced apart across the overlap portion 50 and extend upwards from the overlap portion to rigidify the securing member 44. The overlap portion 50 extends outward from the bottom of the first inner surface 45 and defines a first securing member elongated hole 48 that is configured to receive another one of the hand bolts 30 therethrough.

The pair of receptacles 40 are preferably constructed from sheet steel that is punched, scored, or otherwise cut into a flat blank. The holes 42, 48 are drilled into the first inner surface 45 and the overlap portion 50 while still in the shape of a blank for convenience. The second inner surfaces 47 are formed by bending strips of the sheet steel upwards and inwards at the edges 46 of, and relative to, the first inner surface 45. The overlap portion 50 and the securing member walls 49 are bent upwards to roughly a right-angle relative to the first inner surface 45. The securing member walls 49 are then bent inwards toward the overlap portion 50 at roughly right-angles until the edges of the member walls are in contact with the first inner surface 45. The advantage of sheet steel is its low cost to manufacture and it relatively high strength. Other methods and materials may be used to construct the pair of receptacles 40, however, and still achieve the same functionality.

Each of the receptacles 40 is preferably rigidly attached to the inner channel 22 of a respective one of the elongate rails 20. In this manner, the receptacles are positioned in a spaced relationship across a seating area 18 of the sofa frame 11. Each receptacle is preferably attached by welding the first inner surface 45 to the back edges of the channel 22 and by welding the top edges of the securing member walls 49 to the bottom wall of the inner channel. Attachment of the receptacles 40 to the rails 20 can be performed using other techniques, for instance by using rivets or other fasteners. The positioning of the receptacles 40 allows for the assembly of the backrest 17 at the back of the sofa frame 11 behind the seating area.

The pair of tapered members 60 include a wall structure 66 that defines a plurality of outer surfaces, and a second securing member 63. The wall structure 66 defines a first outer surface 61 and a pair of second outer surfaces 62. The first outer surface 61 is roughly the same size and shape as the tapered triangular opening defined by the top free edges of the second inner surfaces 47 of the receptacles 40. The first outer surface 61 preferably includes a pair of vertical edges 67 and defines a plurality of backrest connector holes 64 that may be transfixed by fasteners to attach the first outer surface, and hence its respective one of the tapered members. 60, to the side of the backrest 17. The downward taper of the vertical edges 67 of the first outer surface 61 promotes the downward interference fit, as described in more detail below. Similar to the armrest connector holes 42 of the pair of receptacles 40, the backrest connector holes 64 are preferably arranged coincident to a plurality of holes in a frame structure that is part of the backrest 17 in order to provide a secure fixation.

The second outer surfaces 62 extend outwards from the vertical edges 67 of the triangular shape of the first outer surface 61 and at an obtuse angle to the first outer surface. Restated, the pair of second outer surfaces 62 are spaced apart across the first outer surface 61 and extend outwards from the vertical edges 67 of the triangular shape of the first outer surface. The lateral taper defined by the second outer surfaces 62 promotes the positive fit in the lateral direction.

As mentioned above, the vertical and horizontal taper of the tapered slot 43 defined by the wall structure each of the pair of receptacles 40 which receives the roughly matching vertically and horizontally tapered surfaces of each pair of tapered members 60 ensures a horizontal and vertical positive fit. Advantageously, the horizontal and vertical components of the positive fit rigidify the connection of the backrest 17 to the remaining parts of the sofa frame 11 in both the side-to-side direction and front-to-back direction, respectively, relative to the sofa frame. Such rigidity reduces the wobble, rocking, or other displacements, that frequently occur in conventional modular, knockdown or RTA furniture. The vertical component of the taper, and the vertical positive fit, is exemplified by the flattened triangular shape of the tapered slot 43 and the tapered members 60, as shown in FIGS. 4 and 5. FIG. 6 best illustrates the lateral, or horizontal, component of the taper and the lateral, or horizontal, positive fit by showing the trapezoidal cross-section of the tapered slot 43 and the one of the tapered members 60 received therein. It should be noted that the vertical and horizontal components of the positive fit can be accomplished using a range of tapered shapes that do not necessarily separate the various components of the positive fit into isolated surfaces, such as with a conical tapered member that is received by a conical receptacle. It should also be noted that the positive fit components are referred to as orthogonal components in a Cartesian system, but could also be referenced to other coordinate systems.

The second securing member 63 extends laterally from the first outer surface 61 and defines a hole 68 surrounded by a fixed nut 65 threaded to receive the hand bolt 30 that is extended through the first securing member hole 48. Insertion of the hand bolt 30 through the hole 48 and the hole 68, into the fixed nut 65 with subsequent rotation draws the respective one of the tapered members 60 further into its respective one of the receptacles 40 and thereby increases the strength of both components of the positive fit. Increasing the positive fit advantageously further reduces the likelihood of wobble or other instability of the backrest 17. In another embodiment, illustrated in FIGS. 2 and 4–6, the second securing member flares outward and downward above the lateral extension so as to provide space for the inner channel 22 to pass therethrough.

The pair of tapered members 60 are preferably constructed from sheet steel cut into a flat blank, generally similar to the method of constructing the pair of receptacles 40. The holes 64, 68 are preferably drilled into the first outer surface 61 and the second securing member 63 while still in the shape of a blank. The second outer surfaces 62 are formed by bending strips of the sheet steel downwards at the edges 67 and away from the first outer surface 61. The second securing member 63 is bent upwards at roughly a right angle to the first outer surface 61 and into a slightly rounded shape for additional rigidity. Other methods and materials may be used to construct the pair of receptacles 40, however, and still achieve the same functionality.

Assembly of the sofa frame 11 using the frame support assembly 14 can be thought of as occurring in two stages. In a first stage, the more permanent fixations, typically using fasteners other than the hand bolts 30, are performed at a factory or a store. The first stage may also be performed, typically only once, by the customer such as when the sofa 10 is shipped in mostly unassembled condition. In the first stage, the pair of elongate rails 20 are elongated or shortened by sliding the inner channel 22 within the outer channel 21 in ½ inch increments until the space between the brackets 27, 28 match the depth of the armrests 16. The length of the rails 20 are fixed by insertion and tightening of the adjustment bolt 25 into the adjustment hole 32 and the coincident one of the adjustment holes 26. The rails 20 are each affixed to their respective one of the pair of armrests 16 by inserting fasteners through the armrest connector holes 23 and the armrest bracket holes 31. The pair of tapered members 60 are spaced apart and affixed to opposite sides of the backrest 17 by inserting fasteners through the backrest connector holes 64. Although the first stage is capable of being reversed, it is generally not as easy as undoing the second stage.

The second stage can be performed anywhere, and without tools, and is generally easier than the first stage. The second stage is ideal for a customer needing to disassemble the sofa, so that it is light enough to be carried and small enough to fit easily through doors and up stairwells, and then reassemble the sofa once it has reached its destination. The second stage is performed by spacing apart the pair of base walls 15 on opposing front and back sides of the armrests 16. A front one of the base walls 15 is abutted against the first end-bracket 27 of each of the rails 20 and a rear one the base walls is abutted against the second end-bracket 28 of each of the rails. The base walls 15 are secured to their respective brackets by inserting pairs of the hand bolts 30 through their respective pairs of base wall slots 29 and into predrilled holes in the base walls. The pair of spring unit supports 55 (or sleeper 56, or futon 57 supports, as desired) are attached to their respective ones of the elongate rails 20 by using the appropriately configured drop-in connector holes 24, so that the spring unit supports are in a spaced relationship on opposing sides of the seating area of the sofa frame 11. The drop-in spring unit 12 is dropped onto the tops of the spring unit supports 55. The backrest 17 is joined to the rest of the sofa frame 11 by inserting the pair of tapered members 60 on either side of the backrest into the corresponding pair of receptacles 40 until the second securing member 63 overlaps the first securing member 44. The connection of the backrest is then further secured by inserting one of the hand bolts 30 through the first securing member hole 48 of each of the pair of receptacles and tightening the bolt into the fixed nut 65 of the respective one of the pair of tapered members 60. The seating area is prepared by placing the cushions 13 in their proper positions on the spring unit 12. Reversing the second stage allows the sofa frame 11 to be broken into separate modular sofa parts.

It should be further noted that the positive fit characteristics of the present invention could be advantageously used to secure together other furniture pieces, and should not be considered limited to backrest attachment, or even sofas.

The present invention has several advantages. The modular sofa parts are firmly interconnected by the frame assembly 14 into the sofa frame 11, while still being easy to assemble and disassemble without tools due to the use of several hand bolts 30 and the positive fit of the tapered members 60 and receptacles 40. The modular assembly further speeds up the assembly at the plant, showroom or home and can be performed by a single person. The modular sofa parts are also more efficiently shipped due to more dense packing of the parts. The positive fit of the tapered members into the receptacles, aided by the securing members 48, 63 increases stability of the backrest 17 in at least two directions. The securing members are positioned so that they can be tightened before drop-in of the drop-in unit and do not require an unsightly access panel or hole in the upholstery. The sofa frame, and frame assembly, are easily adapted for use with a plurality of drop-in units, including a spring unit, a sleeper unit and a futon unit.

Many modifications and other embodiments of the invention will come to mind to one skilled in the art to which this invention pertains having the benefit of the teachings presented in the foregoing descriptions and the associated drawings. For instance, the term fastener, as used herein, is not meant to be limiting and may include such fasteners as rivets, bolts, screws, nails, with, and without washers, bolts and other fixation aids. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method of assembling a plurality of modular sofa parts together into a sofa, said modular sofa parts comprising at least a pair of end supports and a backrest, said method of assembling the sofa comprising:

attaching each of a pair of elongate rails to a respective end support at a first position adjacent to the backrest and at least one other position located further toward a front of the sofa and at least beyond a midpoint of the end support;

attaching each of a pair of tapered members to the backrest; and inserting the tapered members attached to the backrest into corresponding tapered slots supported by the elongate rails so that the modular sofa parts can be secured together in a positive fit.

2. A method of assembling the sofa of claim 1, further comprising positioning a first securing member of each of a pair of receptacles that define the tapered slots in an overlapping relationship with a second securing member of each of the pair of tapered members and securing the first and second securing members together, thereby drawing the tapered members into the corresponding tapered slots.

3. A method of assembling the sofa of claim 1, further comprising attaching a support platform to the pair of elongate rails.

4. A method of assembling the sofa of claim 3, wherein the support platform is selected from a group of support platforms comprising a futon platform, a sleeper platform and a spring platform.

5. A method of assembling a plurality of modular sofa parts together into a sofa, said modular sofa parts comprising at least a pair of end supports and a backrest, said method of assembling the sofa comprising:

attaching each of a pair of elongate rails to a respective end support;

attaching each of a pair of tapered members to the backrest;

inserting the tapered members attached to the backrest into corresponding tapered slots supported by the elongate rails so that the modular sofa parts can be secured together in a positive fit; and adjusting a length of each of the elongate rails to match a length of the respective end support.

* * * * *